United States Patent [19]

Kaneda

[11] Patent Number: 4,879,580

[45] Date of Patent: Nov. 7, 1989

[54] IMAGE PROCESSING APPARATUS

[75] Inventor: Tokuzo Kaneda, Tokyo, Japan

[73] Assignee: Ricoh Company, Ltd., Tokyo, Japan

[21] Appl. No.: 203,996

[22] Filed: Jun. 8, 1988

[30] Foreign Application Priority Data

Jun. 8, 1987 [JP] Japan ..... 62-141384
Apr. 27, 1988 [JP] Japan ..... 63-102431

[51] Int. Cl.[4] ..... G03G 15/00

[52] U.S. Cl. ..... 355/295; 355/282; 355/309; 219/216

[58] Field of Search ..... 355/3 R, 3 FU, 14 FU, 355/3 SH, 14 SH; 219/216; 432/60

[56] References Cited

U.S. PATENT DOCUMENTS 4,212,631 7/1980 Franke et al. ..... 219/216
4,362,502 12/1982 Motomura et al. ..... 432/60
4,443,092 4/1984 Eisbein et al. ..... 355/3 R
4,563,078 1/1986 Fantuzzo et al. ..... 355/3 R
4,589,758 5/1986 Kasama et al. ..... 355/3 FU
4,652,110 3/1987 Sato et al. ..... 355/3 FU
4,671,643 6/1987 Shigemura et al. ..... 355/3 FU

*Primary Examiner*—A. C. Prescott
*Attorney, Agent, or Firm*—Oblon, Spivak, McClelland, Maier & Neustadt

[57] ABSTRACT

An image processing apparatus including a photoconductive element, an optical unit and a fixing device such as a copier or a facsimile apparatus. A mechanism for driving a fixing roller and a pressing roller which constitute the fixing device is supported by members which are isolated from those members which support the optical unit and photoconductive element. Hence, oscillation developed by the driving mechanism which is associated with the fixing device is prevented from being transmitted to the photoconductive element and optical unit.

10 Claims, 8 Drawing Sheets

IMAGE PROCESSING APPARATUS

BACKGROUND OF THE INVENTION

The present invention relates to a copier, facsimile apparatus, printer or like image processing apparatus for forming an image on a photoconductive element which is in the form of a drum or a belt in response to an image signal and transferring the image to a paper.

There has been known an image processing apparatus of the type including an optical unit for providing a latent image on a photoconductive element by electrostics or potential, a developing device for developing the latent image, a transferring device for transferring the resulting toner image from the photoconductive element to a paper, and a fixing device having a fixing roller and a pressing roller for fixing the toner image on the paper. In this type of apparatus, the optical unit and the fixing unit are customarily supported by common support members, i.e. side walls of the apparatus. The fixing and pressing rollers of the fixing device are pressed against each other by a substantial force in order to fix the toner on the paper at a high speed. At the instant when the paper is nipped by the fixing and pressing rollers, the load noticeably fluctuates and this fluctuation of load is transmitted to the optical unit via the side walls which support both of the optical unit and fixing device. As a result, a lens, mirrors and others of the optical unit are caused to oscillate to disturb the position of a beam which is emitted from the optical unit toward the photoconductive element, thereby distorting the image which should be formed on the photoconductive element

SUMMARY OF THE INVENTION

It is therefore an object of the present invention to eliminate the drawback particular to the prior art image processing apparatus as discussed above.

It is another object of the present invention to provide an image processing apparatus which is free from the influence of the substantial fluctuation of load which would otherwise distort an image, while enhancing resolution.

It is another object of the present invention to provide a generally improved image processing apparatus.

An image processing apparatus of the present invention comprises a photoconductive element, an optical unit for forming a latent image on the photoconductive element, a developing device for developing the latent image on the photoconductive element to produce a toner image, a transferring device for transferring the toner image from the photoconductive element to a transfer material, a fixing device constituted by a fixing roller and a pressing roller for fixing the toner which has been transferred to the transfer material, a fixing device driving mechanism for driving the fixing device, a first support for supporting the photoconductive element and optical unit, and a second support for supporting the fixing device and fixing device drive mechanism, the second support being isolated from the first support.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art image processing apparatus.

Figure 1:
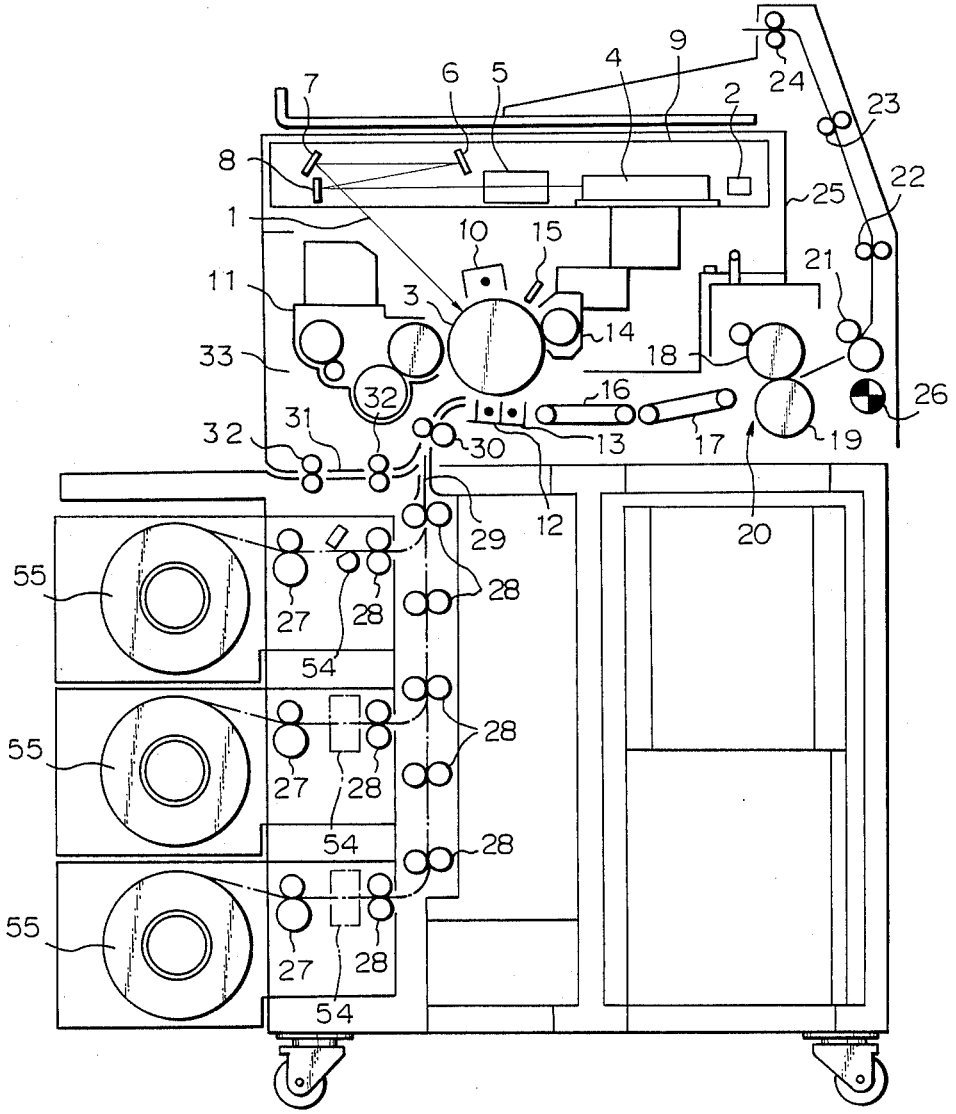
FIG. 1 is a view schematically showing a copier which is an example of prior art image processing apparatuses.

Referring to FIG. 1, a prior art copier which is an example of image processing apparatuses is shown. As shown, the copier includes a laser beam emitting device 2, an optical unit 9 comprised of optics which is made up of a polygonal mirror 4, a cylindrical lens 5, mirrors 6, 7 and 8 and the like for projecting a laser beam 1 from the device 2 toward a photoconductive element 3, a charger 10 for charging the photoconductive element 3, a developing device 11 for developing a latent image formed on the charged photoconductive element 3 by the laser beam 1, a transfer charger 12 for transferring the resulting toner image from the photoconductive element to a paper, a separation charger 13, a cleaning device 14 for cleaning the photoconductive element 3 after the transfer of the toner image, and a discharging device 15 for discharging the photoconductive element 3. The paper to which the toner image has been transferred is transported by belts 16 and 17 to a fixing device 20. In the fixing device 20, a fixing roller 18 and a pressing roller 19 cooperate to melt the toner to thereby fix the toner image on the paper. The paper coming out of the fixing device 20 is driven out of the copier by a feed roller 21, guide rollers 22 and 23, and a discharge roller 24. More specifically, the paper is fed from, for example, one of paper rolls 55 by a feed roller 27 which is associated with the roll, then advanced by a guide roller 28 through a path 29, and then driven by a register roller 30 at a predetermined timing to reach a transfer station where the transfer charger 12 is located. A cutter 54 is provided for cutting a suitable length of the paper 55. A plurality of rolls 5 each having a different width may be loaded in the copier, e.g. three rolls as illustrated. If desired, papers 55 may be manually inserted into a path 31 one at a time in which case they will be fed by feed rollers 32 toward the register roller 30.

Figure 2:
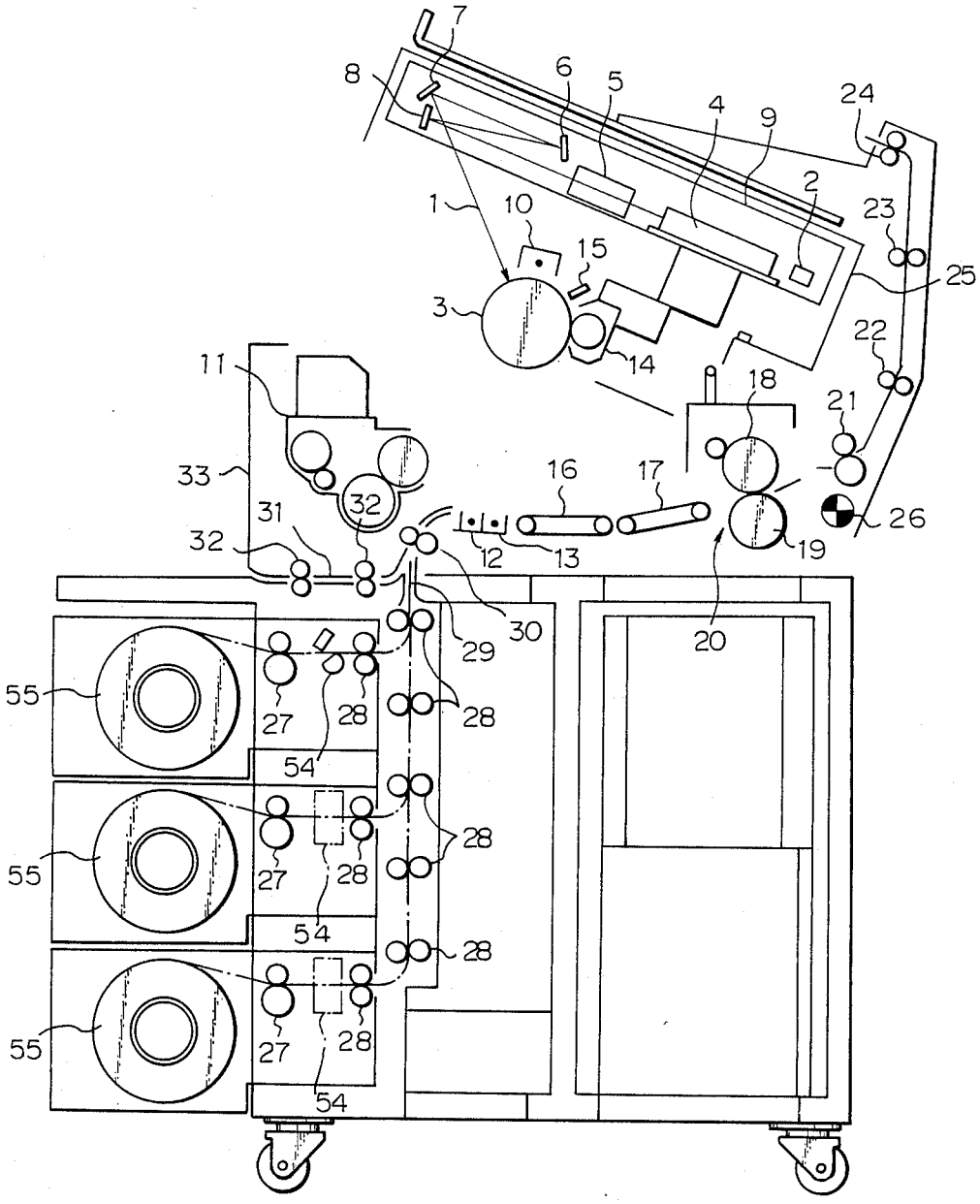
FIG. 2 is a view schematically showing the copier of FIG. 1 with its upper section opened.

In such a prior art copier, the optical unit 9, photoconductive element 3, cleaning device 14 and a driving system associated therewith and the fixing device 20, feed roller 21, guide rollers 22 and 23, discharge roller 24 and a driving system associated therewith are supported by common side walls 25 of an upper section of the copier. The side walls 25 are rotatable upward about a pivot 26 to facilitate the removal of a jamming sheet and maintenance. For example, when the side walls 25 of the copier upper section are rotated upward about the pivot 26 away from a framework 33 of a copier lower section, as shown in FIG. 2, the photoconductive element 3 and other image forming parts are exposed to promote easy removal of a jamming paper and maintenance. In this instance, the optical unit 9, photoconductive element 3, charger 10, cleaning device 14 and discharging device 15 are supported by the side walls 25 of the copier upper section and therefore movable integrally with the side walls 25. On the other hand, the developing device 11, transfer charger 12, separation charger 13, belts 16 and 17 and the rollers 18 and 19 of the fixing device 20 are supported by the framework 33 of the copier lower section which is stationary.

Figure 3:
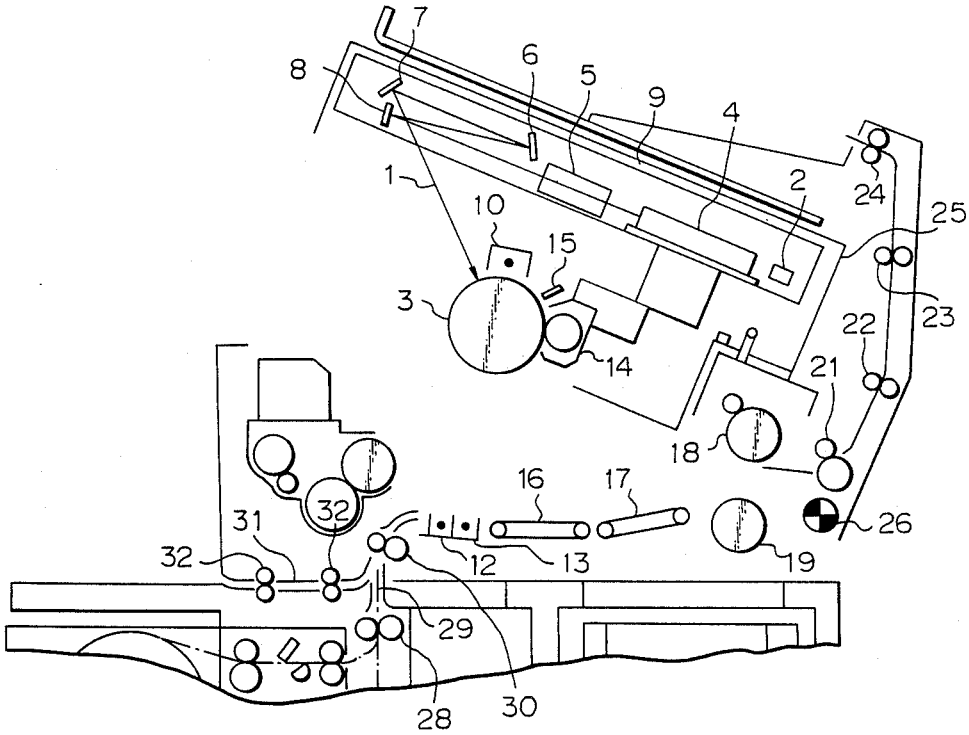
FIG. 3 is a schematic view similar to FIG. 2; showing another prior art copier with its upper section opened.

In an alternative prior art copier shown in FIG. 3, only the fixing roller 18 of the fixing device 20 is supported by the side walls 25 of the copier upper section to be movable together with the photoconductive element 3 and the like. The pressing roller 19 is supported by the framework 33 of the copier lower section which is stationary.

Figure 4:
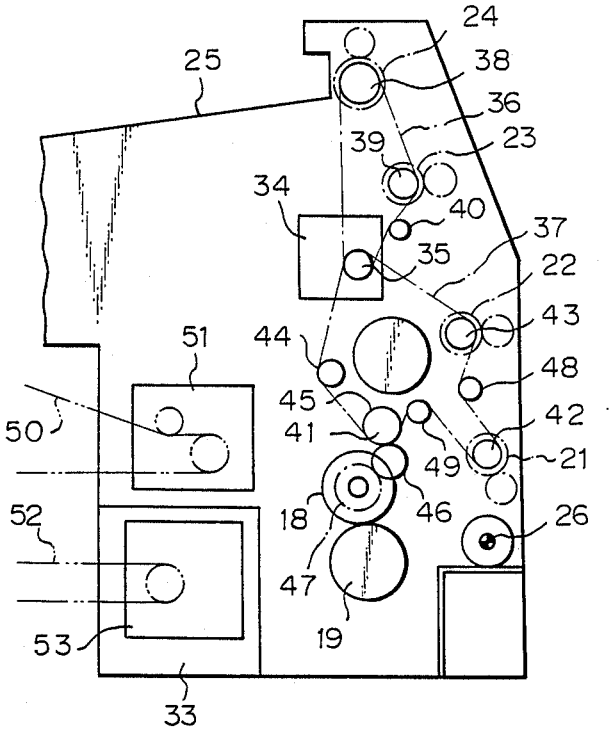
Fig. 4 PRIOR ART
FIG. 4 is a view schematically showing a driving system which is associated with a fixing device of FIG. 2.

FIG. 4 shows a driving system which is associated with the prior art copier of FIG. 2. As shown, the driving system includes a motor 34 which is securely mounted on the side walls 25 of the copier upper section. A belt pulley 35 is rigidly mounted on the output shaft of the motor 34 while a first and a second timing belt 36 and 37, respectively, are passed over the belt pulley 35. The rotation of the motor 34 is transmitted by the first and second timing belts 36 and 37. The first timing belt 36 is passed over a first and a second belt pulley 38 and 39, respectively, and held under tension by a tension pulley 40. The first and second belt pulleys 38 and 39 are supported by a shaft of the discharge roller 24 and a shaft of the guide roller 23, respectively. The first timing belt 36 is adapted to drive the discharge roller 24 and guide roller 23. On the other hand, the second timing belt 37 is passed over a third belt pulley 41, a fourth belt pulley 42, a fifth belt pulley 43, and idle pulleys 44 and 48 and held under tension by a tension pulley 49. A gear 45 is mounted on a shaft which supports the third belt pulley 41 and meshed via an intermediate gear 46 with a gear 47 which is mounted on the shaft of the fixing roller 18.

In the above construction, the rotation of the motor 34 is transmitted to the fixing roller 18 via the second timing belt 37 and gears 45, 46 and 47, whereby the roller 18 is driven in a rotary motion. The pressing roller 19 is pressed against the fixing roller 18. Securely mounted on the shaft of the feed roller 21, the fourth belt pulley 42 rotates the feed roller 21. Fixed to the shaft of the guide roller 22, the fifth belt pulley 43 rotates the guide roller 22 which is rigid on the shaft of the guide roller 22. The intermediate gear 46 may advantageously be designed to be rotatable about the gear 45. Such an intermediate gear 46 will be moved when it fails to accurately mesh with the gear 47 in the event of downward movement of the side walls 35, attaining accurate mesh with the gear 47 upon the start of rotation.

Also supported by the side walls 25 is a motor 51 which is adapted to drive the photoconductive element 3 and its associated members via belt 50. The motor 51 therefore is rotatable about the pivot 26 together with the side walls 25. A motor for driving the belts 16 and 17 and register roller 30 via a belt 52 is securely mounted on the framework 33 of the copier lower section and therefore held stationary irrespective of the angular movement of the side walls 25.

Figure 5:
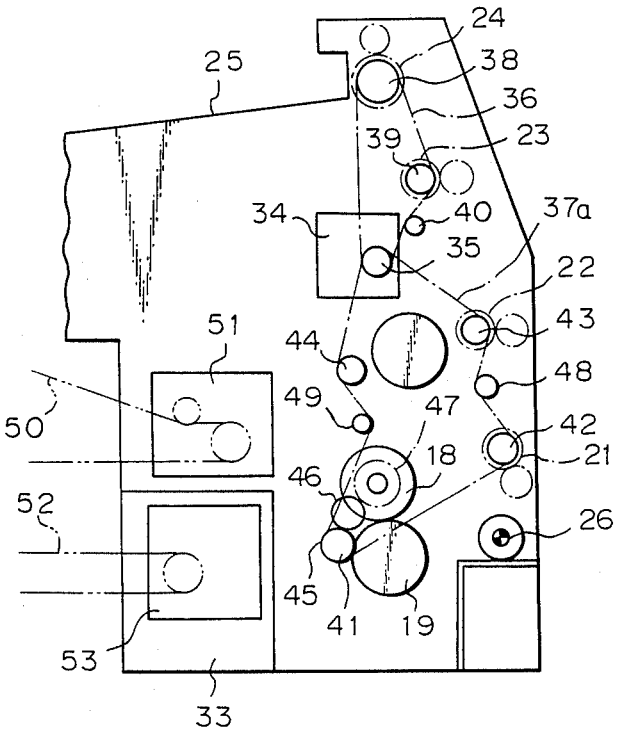
Fig. 5 PRIOR ART
FIG. 5 is a schematic view corresponding to FIG. 4 which is associated with the prior art copier of FIG. 3.

FIG. 5 shows a driving system which may be associated with the construction shown in FIG. 3. In FIG. 5, the structure associated with the first timing belt 36 is identical with the structure of FIG. 4 and therefore will not be described to avoid redundancy. A second timing belt **37*a* is passed over the third belt pulley 41, fourth belt pulley 42, fifth belt pulley 43 and idle pulleys 44 and 48 and held under tension by the tension pulley 49. The third to fifth belt pulleys 41 and 43 are respectively connected to the fixing roller 18, feed roller 21, and guide roller 22 as in the arrangement of FIG. 4. The third belt pulley 41 and the gears 45, 46 and 47 are different from those of FIG. 4 with respect to the position. Since the system of FIG. 5 is basically the same as the system of FIG. 4**, details thereof will not be described.

Figure 6:
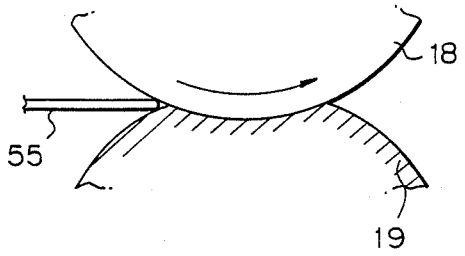
Fig. 6 A PRIOR ART
FIGS. 6A and 6B are schematic views showing respectively a condition in which a paper is about to be nipped by a fixing roller pair and a condition in which it has been nipped by the fixing roller pair.
Figure 6:
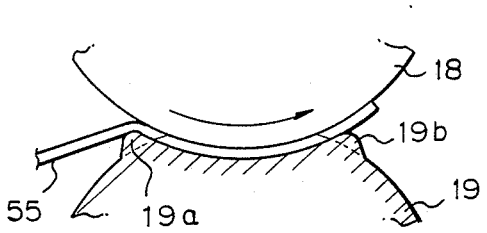
Fig. 6 B PRIOR ART

Generally, the fixing roller 18 and the pressing roller 19 of the fixing device are pressed against each other by a substantial force in order to fix toner at a high speed. As shown in FIG. 6, when the paper 55 is thrusted into a nipping section of the fixing roller 18 and pressing roller 19 which are rotating in a steady condition, the paper 55 tends to move through the nipping section before the pressing roller 19 which is located below the fixing roller 18 is lowered by the thickness of the paper 55. This tendency of the paper 55 increases with the linear velocity. Hence, as shown in FIG. 6B, protuberances **19*a* and 19*b* each corresponding to the thickness of the paper 55 is produced on the pressing roller 19 due to deformation of the roller 19. The protuberances 19*a* and 19*b* increase the energy which tends to bend the paper 55. Even if the linear velocity is low, a substantial pressing force prolongs the nipping period and thereby increases the bending energy. Further, the smaller the diameter of the fixing roller 18**, the greater the bending energy is. It follows that even a miniature copier suffers from critical fluctuation of load depending upon the conditions of use.

In the prior art copier, when the paper 55 carrying a toner image thereon enters and leaves the nipping section of the fixing roller 18 and pressing roller 19, the load is fluctuated. As this fluctuation of load causes the drive means for the rollers 18 and 19 to oscillate, the oscillation is transmitted via the side walls 25 of the copier upper section to the lens 5 and mirrors 6, 7 and 8. Consequently, the position on the photoconductive element 3 to which the laser beam 1 should be incident is deviated by, for example, the amount of oscillation of the mirrors 6, 7 and 8. Moreover, the toner image on the photoconductive elemnt 3 and therefore the image reproduced on the paper 55 is distorted.

An image processing apparatus in accordance with the present invention which eliminates the shortcoming discussed above is constructed and operated as will be described in detail hereinafter.

The overall structure of a copier which is representative of the image processing apparatus of the present invention may be the same as the prior art. Specifically, the present invention is applicable to a copier having any of the structures which have been discussed with reference to FIGS. 1 to 3.

Figure 7:
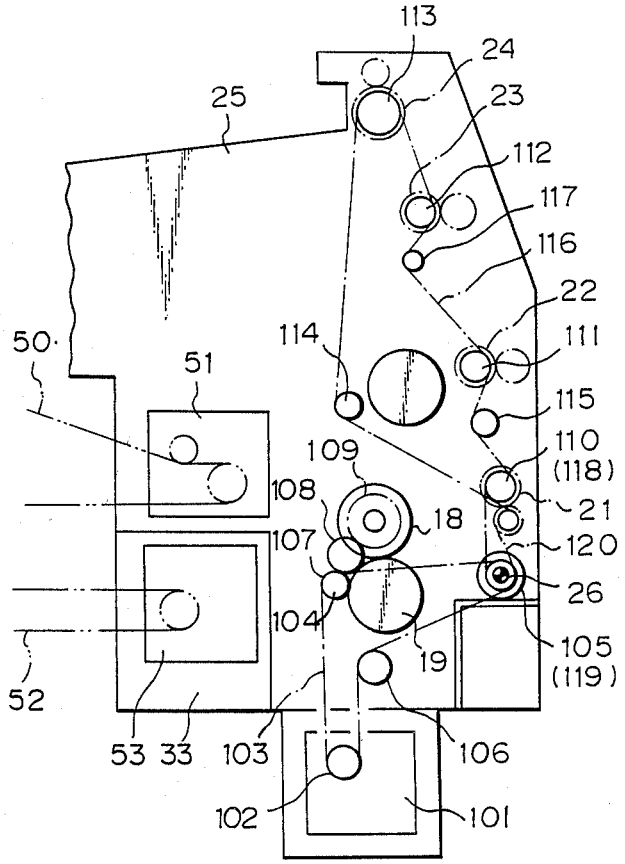
FIGS. 7 and 8 are views similar to FIG. 4 and 5, schematically showing an image processing apparatus embodying the present invention and a modification thereto, respectively.

Referring to FIG. 7, the copier in accordance with the present invention includes a motor 101 which is exclusively assigned to a fixing device and mounted on a framework 33 of a lower section of the copier. A belt pulley 102 is mounted on the output shaft of the motor 101 while a timing belt 103 is passed over the belt pulley 102. A tension pulley 106 is passed over a belt pulley 104 and an intermediate belt pulley 105 which is supported coaxially with a pivot 26 about which side walls 25 of a copier upper section are rotatable, applying tension to the timing belt 103. A gear 107 is mounted on a shaft which supports the belt wheel 104. The gear 107 is held in mesh with a gear 109 which is mounted on a shaft which supports the fixing roller 18. The motor 101 drives the fixing roller 18 via the timing belt 103 and gears 107, 108 and 109.

Mounted on the side walls 25 of the copier are a belt pulley 110 which is connected the feed roller 21, belt pulleys 111 and 112 connected to guide rollers 22 and 23, respectively, a belt pulley 113 connected to a discharge roller 24, and a timing belt 116 which is passed over intermediate belt pulleys 114 and 115. A tension pulley 117 is provided for applying tension to the timing belt 116. A shaft which supports the belt pulley 110 and a shaft which supports the intermediate belt pulley 105 may be connected to each other by belt pulleys 118 and 119 which are individually mounted on those shafts and a timing belt 120 which is passed over the belt pulleys 118 and 119. Further, the intermediate belt pulley 105 and belt pulley 119 may be implemented as a double pulley, and so may be done the belt pulley 110 and belt pulley 118. In such a construction, the motor 101 drives the fixing roller 18, feed roller 21, guide rollers 22 and 23, and discharge roller 24.

Assume that the drive means shown in FIG. 7 is caused to oscillate due to the fluctuation of load which is ascribable to the movement of a paper 55 between the fixing roller 18 and the pressing roller 19. In accordance with the present invention, the oscillation of the drive means is not transmitted to the optical unit 9 and others which are mounted on the side walls 25 of the copier upper section because the side walls 25 are substantially isolated from the framework 33 of the copier lower section with respect to oscillation.

The driving system including the timing belt 116 and adapted to drive the feed roller, guide roller and discharge roller and the driving system including the timing belt 103 are operatively connected to each other. Hence, oscillation of the driving system which includes the timing belt 103 is partly imparted to the side walls 25. Nevertheless, the oscillation associated with the mass of the motor 101 is prevented from being transmitted to the side walls 25 because the motor 101 is mounted on the framework 33.

Figure 8:
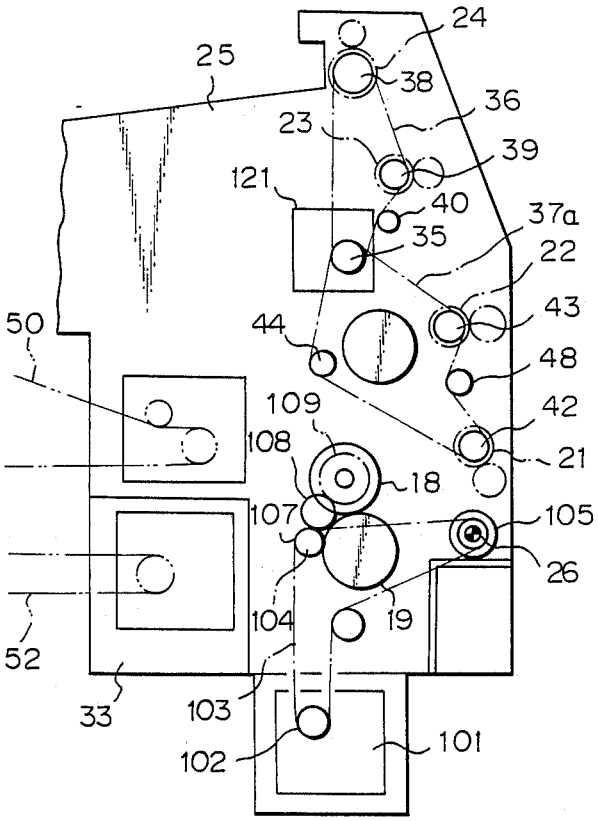

Referring to FIG. 8, a modification to the embodiment of FIG. 7 is shown. In FIG. 8, the driving system with the timing belt 103 which drives the fixing roller 18 and the driving system which drives various members that are mounted on the side walls 25 are fully separated from each other. This of course further enhances the prevention of transmission of oscillation. An extra motor 121 is mounted on the side walls 25 for driving the rollers which are mounted on the side walls 25. The motor 121 may be arranged as in the prior art of FIG. 5 so as to implement a first and a second timing belt system similar to those of FIG. 5. The construction of FIG. 8 is distinguishable from that of FIG. 5 in that the second timing belt does not have to drive the fixing roller 18 and, for this reason, the third timing belt 41 is omitted. In FIG. 7, the same or similar structural elements as those shown in FIG. 5 are designated by like reference numerals.

As shown in any of FIGS. 7 and 8, the optical unit 9, photoconductive element 3 and motor 51 associated therewith which are mounted on the side walls 25 are isolated from the framework 33 which supports the fixing device and motor 103 associated therewith and are joined only at the pivot 26. Hence, the oscillation of the fixing unit 20 is prevented from being transmitted while remaining great enough to effect the optical unit 9.

Since the transporting forces exerted by the discharge rollers 9 and 10 are extremely small, they will develop only a negligible degree of oscillation when mounted on the side walls 25 on which the optical unit 3 is mounted.

In summary, it will be seen that the present invention provides an image processing apparatus which prevents the oscillation of a fixing device which suffers from a substantial fluctuation of load from being transmitted to a photoconductive element and an optical unit. Hence, the apparatus eliminates the deviation of a beam which is directed toward the photoconductive element and therefore the distortion of an image. In addition, the apparatus of the present invention enhances resolution due to the elimination of the deviation of a beam relative to a photoconductive element.

Various modifications will become possible for those skiled in the art after receiving the teachings of the present disclosure without departing from the scope thereof.

What is claimed is:

1. An image processing apparatus comprising:

a photoconductive element;

an optical unit for forming a latent image on said photoconductive element;

a developing device for developing the latent image on said photoconductive element to produce a toner image;

a transferring device for transferring the toner image from said photoconductive element to a transfer material;

a fixing device constituted by a fixing roller and a pressing roller for fixing the toner which has been transferred to the transfer material;

fixing device drive means for driving said fixing device;

first support means for supporting said photoconductive element and said optical unit; and second support means for supporting said fixing device and said fixing device drive means, said second support means being isolated from said first support means.

2. An image processing apparatus as claimed in claim 1, wherein said fixing device drive means comprises a first motor and first transmitting means for transmitting rotation of said first motor to said fixing roller and said pressing roller.

3. An image processing apparatus as claimed in claim 2, further comprising a feed roller, a guide roller and a discharge roller which are supported by said first support means for transporting the transfer material which comes out of said fixing device.

4. An image processing apparatus as claimed in claim 3, further comprising second transmitting means for transmitting rotation of said first motor to said feed roller, said guide roller and said discharge roller.

5. An image processing apparatus as claimed in claim 4, wherein said first transmitting means comprises a first belt for transmitting rotation of said first motor to said fixing roller and said pressing roller, and said second transmitting means comprises a second belt for transmitting rotation of said first motor to said feed roller, said guide roller and said discharge roller and an intermediate belt provided between said first belt and said second belt.

6. An image processing apparatus as claimed in claim 3, further comprising roller drive means for driving said feed roller, said guide roller and said discharge roller, and second transmitting means for transmitting rotation of said roller drive means to said feed roller, said guide roller and said discharge roller.

7. An image processing apparatus as claimed in claim 6, wherein said roller drive means comprises a second drive motor.

8. An image processing apparatus as claimed in claim 7, wherein said second transmitting means comprises a belt for transmitting rotation of said second drive motor to said feed roller, said guide roller and said discharge roller.

9. An image processing apparatus as claimed in claim 1, wherein said first support mans comprises side walls of an upper section of said apparatus, and said second support means comprises a framework of a lower section of said apparatus.

10. An image processing apparatus as claimed in claim 9, wherein said side walls and said framework are rotatably connected to each other by a pivot.

* * * * *